United States Patent [19]

Blessing et al.

[11] Patent Number: 4,871,161

[45] **Date of Patent: * Oct. 3, 1989**

[54] SEPARATING AND FEEDING GARMENT PARTS

[75] Inventors: Hubert Blessing, Dallas; Richard L. Harrington, Farmersville, both of Tex.

[73] Assignee: Levi Strauss & Co., San Francisco, Calif.

[ * ] Notice: The portion of the term of this patent subsequent to Aug. 25, 2004 has been disclaimed.

[21] Appl. No.: 915,148

[22] Filed: Oct. 3, 1986

Related U.S. Application Data

[63] Continuation-in-part of Ser. No. 649,503, Sep. 11, 1984, Pat. No. 4,688,781.

[51] Int. Cl.[4] ..... B65H 3/22

[52] U.S. Cl. ..... 271/10; 271/18.3; 271/121; 271/151; 271/167

[58] Field of Search ..... 271/10, 18.3, 37, 121, 271/167, 149–151

[56] References Cited

U.S. PATENT DOCUMENTS

| | | | |
|---|---|---|---|
| 868,317 | 10/1907 | Allen | 271/121 |
| 939,182 | 11/1909 | Allen | 271/121 |
| 2,151,228 | 3/1939 | Pflanze | 271/1 |
| 2,584,730 | 2/1952 | Novick | 271/62 |
| 3,149,835 | 9/1964 | Branscome | 271/62 |
| 3,442,505 | 5/1969 | Szentkuti | 271/1 |
| 3,545,741 | 12/1970 | Porth | 270/58 |
| 3,738,645 | 6/1973 | Gray et al. | 271/26 R |
| 3,908,983 | 9/1975 | Long | 217/35 |
| 3,981,495 | 9/1976 | Bijttebier | 271/18.3 |
| 4,046,369 | 9/1977 | Kluge et al. | 271/3.1 |
| 4,049,260 | 9/1977 | Szymborski | 271/151 |
| 4,143,871 | 3/1979 | Blessing | 217/10 |
| 4,283,047 | 8/1981 | Blessing | 271/10 |
| 4,506,876 | 3/1985 | Nishibori | 271/104 |
| 4,544,149 | 10/1985 | Graef et al. | 271/107 |
| 4,591,140 | 5/1986 | Illig et al. | 271/11 |
| 4,688,781 | 8/1987 | Blessing | 271/11 X |

FOREIGN PATENT DOCUMENTS

| | | | |
|---|---|---|---|
| 998406 | 10/1976 | Canada . | |
| 413450 | 5/1925 | Fed. Rep. of Germany . | |
| 516768 | 2/1931 | Fed. Rep. of Germany . | |
| 521624 | 3/1931 | Fed. Rep. of Germany | 271/37 |
| 113637 | 9/1981 | Japan | 271/94 |
| 371615 | 4/1932 | United Kingdom | 271/37 |

*Primary Examiner*—Richard A. Schacher
*Attorney, Agent, or Firm*—Limbach, Limbach & Sutton

[57] ABSTRACT

Apparatus for the seriatim separation and feeding of garment parts from a shingled stack of the parts to a predetermined destination. Comprising the apparatus is a picker head containing a depending array of needles adapted to positively engage the leading edge of the uppermost part on the stack. The picker head is supported for arcuate motion in the course of effecting separation of the engaged first part, and is arcuately displaced at a high rate of acceleration to aid in overcoming the resistance to separation between the first and second parts in the stack. Following separation, the separated part is transferred to a second location at which the head is withdrawn from the transferred part. Operable concomitantly with part separation by the picker head is a hold down clamp for applying a predetermined downward force on the remaining stacked parts while a vacuum force is being applied from underneath for retarding this displacement in the course of the engaged part being separated.

27 Claims, 8 Drawing Sheets

SEPARATING AND FEEDING GARMENT PARTS

This application is a continuation-in-part of application Ser. No. 649,503 filed Sep. 11, 1984 now U.S. Pat. No. 4,688,781.

TECHNICAL FIELD

The field of art to which the invention pertains comprises the art of separating and feeding individual garment parts from a stack for supplying the separated parts to a work station at which manufacturing operations are to be conducted on the part.

BACKGROUND OF THE INVENTION

In the production of garment goods assembled from fabric or other apparel materials, it is customary to cut a number of parts simultaneously from a stack of plural layers or sheets of fabric followed by separation of the fabric layers for further operations. In the manufacture of goods such as shirts and pants, for example, various parts are subjected to preliminary sewing operations such as hemming and/or partial preassembly and then restacked in one form or another and fed to a further operation. The parts are then normally required to be separated from the stack prior to each successive sewing operation. Separation of fabric parts from a stack of parts of like material can be particularly difficult because of the texture of surface roughness that causes the parts to cling to each other and resist separation techniques. Reliable separation processes are therefore needed to facilitate the automation of the manufacturing process.

Disclosed in parent application Ser. No. 649,503, is the stacking of fabric parts wherein the parts are somewhat staggered so that corresponding edges of adjacent parts are arranged somewhat like roof shingles, hence the term "shingled stack", by which improved separation techniques are possible. Staggering the edges of parts of a stack which are aligned with each other at the time the parts are cut out may be obtained by various methods. It can for example be obtained by clamping one edge of the stack and rotating the other edge, then clamping the stack adjacent the other edge and releasing the stack at the first point of clamping to permit the stack to remain in the staggered or shingled configuration. Certain manufacturing processes in the fabrication of apparel parts also inherently discharge the parts from a work station into a staggered or shingled stack configuration. In some instances, where for example the topside and underside of the apparel part have different surface textures and different friction coefficients with materials such as corduroy or brushed denim, the parts may be shingled and removed from the stack in pairs instead of individually.

SUMMARY OF THE INVENTION

The present invention provides further improvements in separating and feeding or transferring pieces of relatively flexible garment materials such as fabric parts of various articles of apparel from a stack of such parts, even though the parts may be formed of various types of garment materials having a tendency to cling or resist separation from adjacent parts in the stack.

In accordance with one aspect of the present invention there is provided an improved apparatus particularly adapted for separating and transferring individual apparel parts arranged in a staggered or so-called shingled stack of parts. The parts are stacked such that an edge, which may be hemmed or unhemmed, or a portion of a surface of the part is positively engaged by a multi-faceted picker assembly connected to a transfer mechanism. The part while still on the stack and which may comprise a partial subassembly of parts is highly accelerated to separate the engaged part from the stack of similar parts remaining thereat. Preferably, the rapid rate of acceleration by which separation is obtained utilizes the well known "tablecloth" effect by which a table cloth can be removed from a table on which it is placed without damaging or first removing the dishes or glassware previously placed on the tablecloth.

In accordance with a preferred mode of the invention, the picker assembly for use on various apparel materials such as woven fabrics, knits, leather and even paper is comprised of a multi-needle array that is operative in an arcuate motion for engaging the leading edge of the part to be separated. The array is mounted on the end of a picker head which is supported for the arcuate motion transmitted to the array. In the course of effecting separation, the head is displaced arcuately at a rapid rate of acceleration sufficient to overcome the surface resistance to separation between the uppermost part being separated and the underneath part next to be separated. Operative concomitantly and in timed relation to the picker assembly is a hold down or clamping mechanism that applies a perpendicular clamping force onto both the removed and the remaining shingles of the stack while a controlled vacuum source is applied from the underside to the undersurface of the apparel part at the bottom of the stack.

The force of the clamping mechanism is applied by a plurality of upstanding spaced apart reciprocably operative plungers having gripping fingers at their distal ends adapted to engage the upper surface of the apparel part being removed. The plungers are arranged substantially normal to the surface on which the stack is being supported and preferably, the plungers are placed so that the engaged topmost part is pulled or drawn past the plungers during the initial acceleration period. By applying the clamping force toward the trailing edge of the first part of the stack in a controlled manner, a greater friction surface force is effected between the remaining parts of the stack to increasingly inhibit the tendency toward a following movement of the second part when the first part is accelerated for separation. Following separation, the separated part is fed or transferred by the picker assembly to a predetermined destination at which the picker array is withdrawn from the transferred part and returned to effect separation and feeding of the next subsequent part of the stack.

Where shingled in pairs, separation of the individual pairs is accelerated as above after which the individual parts are separated from each other before being delivered to their final destination.

Feeding of the garment parts for delivery to a pickoff station for transfer by the picker assembly are two series arranged conveyors operative at relatively different transport speeds controlled to effect a desired spacing of the delivered parts.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENTS

Figure 1:
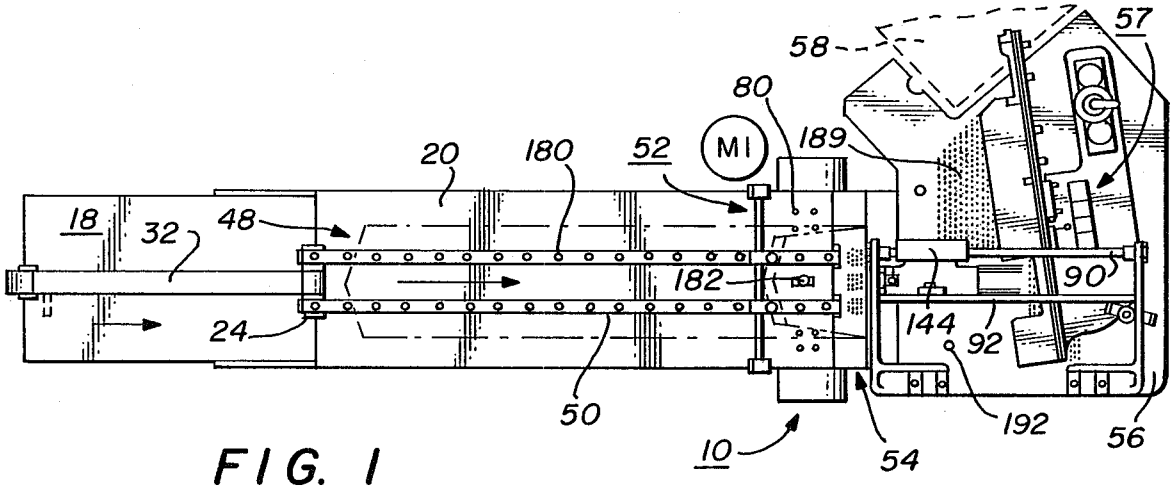
FIG. 1 is a plan view of an apparatus incorporating the invention hereof.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

The apparatus of the present invention is particularly adapted for use in conjunction with the automated manufacture of garment articles of apparel such as denim jeans, and for handling certain parts of the garments in the various stages of the manufacturing process. In particular, the embodiments of the apparatus described in detail herein are utilized for separating precut pieces of fabric for pocket parts of trousers, which pieces may be hemmed along the top edge of the pocket part and stacked in a staggered or shingle configuration. In that arrangement, the parts are oriented relative to each other in the same direction and the corresponding edges are staggered so that an edge or hem of each part is presented to the apparatus for separation of the top part of a stack from the remainder of the stack thereat. Those skilled in the art will recognize that the apparatus may be used in conjunction with separating and feeding various other stacks of different sizes and configurations composed of other garment materials and which may include subassemblies thereof. Parts need not necessarily be hemmed although parts having a hemmed edge or other surface which may be positioned interlocked or engaged will handle with particular ease.

Figure 2:
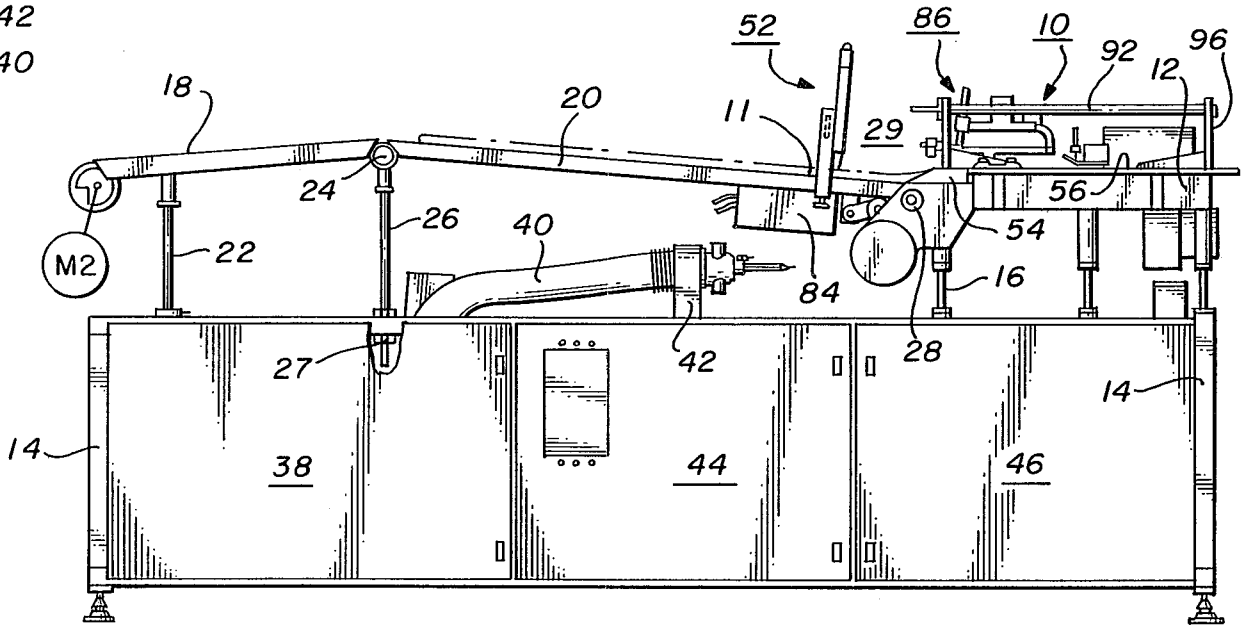
FIG. 2 is a side elevation of FIG. 1.
Figure 3:
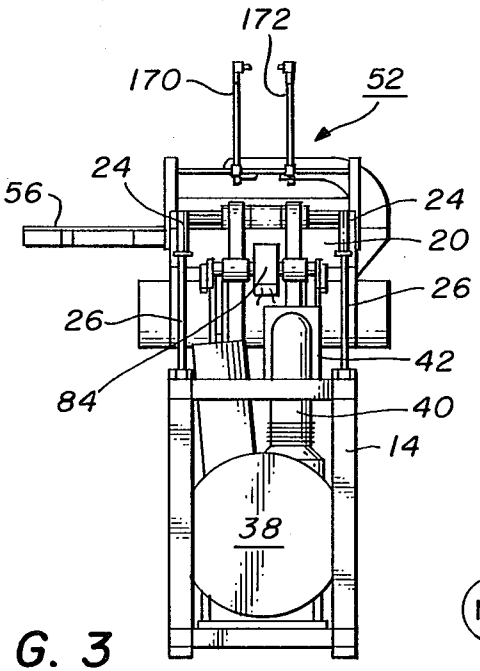
FIG. 3 is an end elevation of FIG. 1.

Referring initially to FIGS. 1–3 of the drawings, the separation and feed mechanism hereof is generally designated 10 and is supported on a horizontal base 12 which in turn is supported on a frame structure 14 via vertically adjustable support legs 16. For supporting and positioning a shingle stack 11 from which individual garment parts 13 can be separated and fed by means of device 10, there is provided an elongated table 20. The table is adjustable for relative inclination while enabling an appropriate height setting to be effected via a journal 24 and a post 26 threaded into sleeve 27 mounted on frame 14. For purposes hereof, table 20 is canted so as to slope downwardly from journal 24 to a journal connection with shaft 28 at the separating and feeding station 29. Supported within frame 14 is a vacuum pump assembly 38 the outlet of which connects to a conduit 40 leading to a manifold 42 from where vacuum pressure is distributed to the various control features as will be described. Behind panel doors 44 and 46 on frame 14 are various operating components, not shown. Optionally, a second table 18 supported on post 22 and extending contiguously rearward of table 20 may be included for reasons as will be described.

Figure 4:
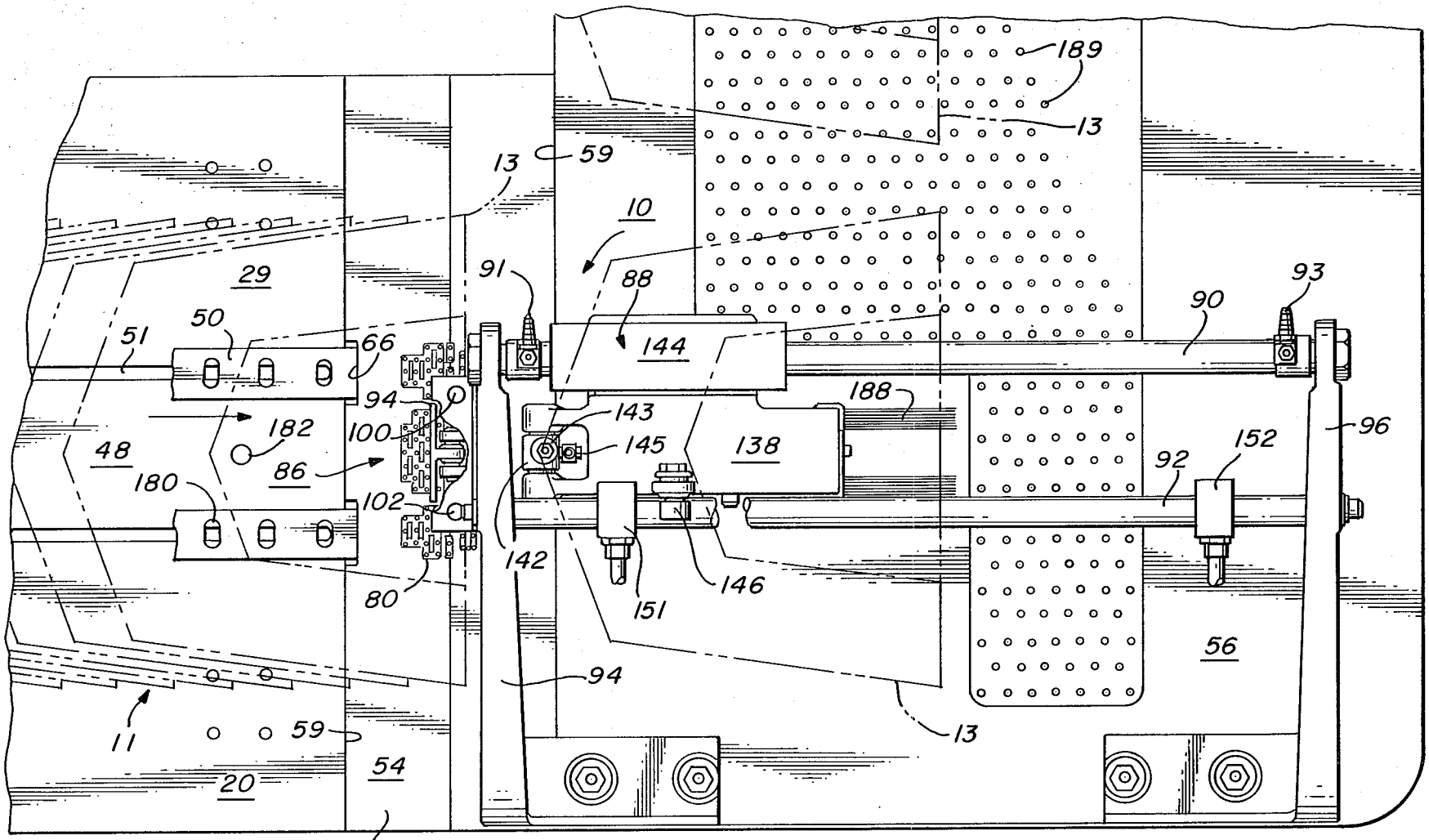
FIG. 4 is an enlarged plan view of the feed and separating mechanism of FIG. 1.

For advancing the individual garment parts to station 29 (see also FIG. 18), table 20 includes a longitudinally extending endless conveyor 48 comprised of a pair of parallel spaced apart endless belts 50 overlying vacuum slots 51 (FIG. 4). Feeding by the conveyor maintains the shingled stack 11 nested at station 29 so that a predetermined quantity of individual garment parts 13 are stacked contiguously confronting a ramp 54 while extending rearwardly beneath a clamping or hold down mechanism 52. Where a table 18 is utilized it includes a second conveyor 32 for delivering the garment parts 13 to conveyor 48. By operating conveyors 32 and 48 at relatively different transport speeds, the shingled spacing of parts 13 can be conveniently controlled. That is, by operating conveyor 48 slower than conveyor 32, the parts 13 will tend to become more compressed or crowded when delivered and stacked at feeding station 29. Conversely operating conveyor 48 faster than conveyor 32 will tend to stretch or expand the stack. The latter is generally preferred for purposes hereof.

As will be appreciated, the angle of table 20 is preferably set by post 26 to match that of the shingled stack and can be conveniently changed to accommodate different material compositions or other requirements as may become desirable. After arriving at ramp 54, the stacked garment parts are separated and fed seriatim via the operating and feeding mechanism 10 over a table 56 to a rear location thereon. Situated at the rear of table 56 is a brush guide assembly 57 by which the individual parts 13 on arrival are subsequently moved laterally to a sewing machine shown in phantom and designated 58. Formed in the surface of table 56 are longitudinal parallel grooves 188 and a plurality of vacuum apertures 189. As will be understood, the separating and feeding apparatus 10 operably includes the clamping mechanism 52 and the vacuum distribution system provided by pump 38.

For supplying the garment parts whereby to form stack 13 at station 29 as previously mentioned, the individual garment parts are delivered partially overlapped by conveyor 48 to block ramp 54. The ramp, as will be described with specific reference to FIGS. 4, 5 and 12–15, is positioned transversely intervening between the leading or forward edge 59 of table 20 and the rearward or trailing edge 61 of table 56. On being delivered to station 29 the leading edges of the stacked parts will engage the upwardly sloped confronting face 62 of ramp 54 essentially in the manner illustrated in FIGS. 5 and 13.

Comprising ramp block 54 in the direction of part feed is the face 62 forming a first ramp portion and defining an angled surface with respect to the plane of table 20. The face in turn merges with a substantially horizontal surfaced second portion 64 that extends to a termination contiguously opposite edge 61 of table 56. Both surface portions are polished and smooth to enable low friction movement of the garment parts thereover. As can be seen, second portion 64 is substantially coplanar with the surface plane of table 56. Formed in the front edge of face portion 62 are two recessed cutouts 66 that enable belts 50 to extend inward and downward thereat to about conveyor idler roll 68. The underside of the ramp block 54 is generally hollow and by means of a plate 70 secured in a horizontal recess 72 via bolts 74, there is defined a vacuum plenum 76 to which vacuum is supplied in a controlled timed relation through conduit connection 78.

Communicating with the plenum 76 through the surface of both the face portion 62 and the horizontal portion 64 are a plurality of normally extending apertures 80 arranged in predetermined patterns providing a wide distribution of vacuum exposure to the underside of the individual garment parts 13. Formed within each aperture pattern to further aid in vacuum distribution are a plurality of surface grooves 82 extending laterally and longitudinally for providing a vacuum interconnection between the various apertures. Conduit 78 is connected to a vacuum canister 84 (FIG. 5) to which vacuum is supplied and removed in a predetermined controlled timed sequence from manifold 42.

For operatively removing or separating the individual garment parts 13 from stack 11, apparatus 10 as will now be described with specific reference to FIGS. 4–6 and 8–11 includes a picker assembly 86. The picker assembly is supported from a carriage 88 mounted via follower cams 146 and 148 on a longitudinal rod 92. Spaced apart and extending parallel to rod 92 is a tubular rod 90 having control air connections 91 and 93 and forming part of a rodless air cylinder 144 mounted on carriage frame 138. Each of the rods 90 and 92 are supported in opposite vertical frame ends 94 and 96 secured on table 56. Supported on a bracket 98 at the forward end of frame 94 are two spaced apart light emitters 100 and 102 that operably cooperate with sensors 182 and 184 (FIG. 12) and the control system hereof as will be understood.

Comprising picker assembly 86 for grasping and separating the uppermost garment part 13 on stack 11 is a picker head 104 that includes an arcuately displaceable head 106 to which at its lower end is secured a flexible picker cloth 107 dependently supporting a plurality of individual needle pickers 105. For the embodiment hereof, the needles 105 are collectively arranged to form at least two separate picker arrays 109 and 111 symmetrically positioned with respect to the vertical axis of head 106. Each needle 105 is individually extended and supported through the picker cloth 107 while head 106 is supported for arcuate movement on a transverse shaft 108 mounted in a clevis 110 of a picker arm 112. Head 106 in that relation is adapted for a rocking or arcuate movement about shaft 108 effected by means of clevis 114 embracing a cross pin 116 extending transversely through the head. Clevis 114 is connected by a spacer 118 to pneumatic piston cylinder 122 having a piston rod 120. The pneumatic cylinder 122 includes a pair of air connectors 124 and 126 and is secured at its rearward end to a cross pin 128 extending through channel bracket 130 mounted on the underside of picker arm 112.

Connecting picker head 104 to carriage 88 is a clevis 132 secured to arm 112 via a cross pin 134 at an intermediate location along the length of arm 112. Clevis 132 in turn is joined to a piston rod 136 of a pneumatic cylinder 142 supported on carriage frame 138. Connectors 143 and 145 provide the control air connections to cylinder 142. It will be appreciated from the foregoing arrangement that when the rod 120 of pneumatic piston 122 is extended leftwardly in FIG. 5 head 106 will be arcuately displaced about shaft 108 in a clockwise direction as shown while cylinder 142 controls the vertical orientation thereof. Concomitantly, when cylinder 144 is operative it will cause carriage 88 to traverse rod 90 rightwardly in FIG. 5 to the position shown in phantom whereby the picker assembly 86 can be alternatively moved from a first position shown solid in FIG. 5 to a second position shown in phantom thereon. Supported in and about the picker assembly for purposes of controlling operation are magnetic microswitches 150, 151 and 152.

Figure 11:
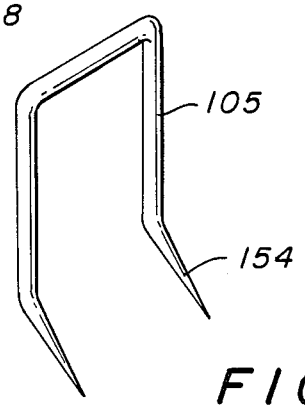
FIG. 11 is an enlarged perspective elevation of an individual needle of the picker array.
Figure 12:
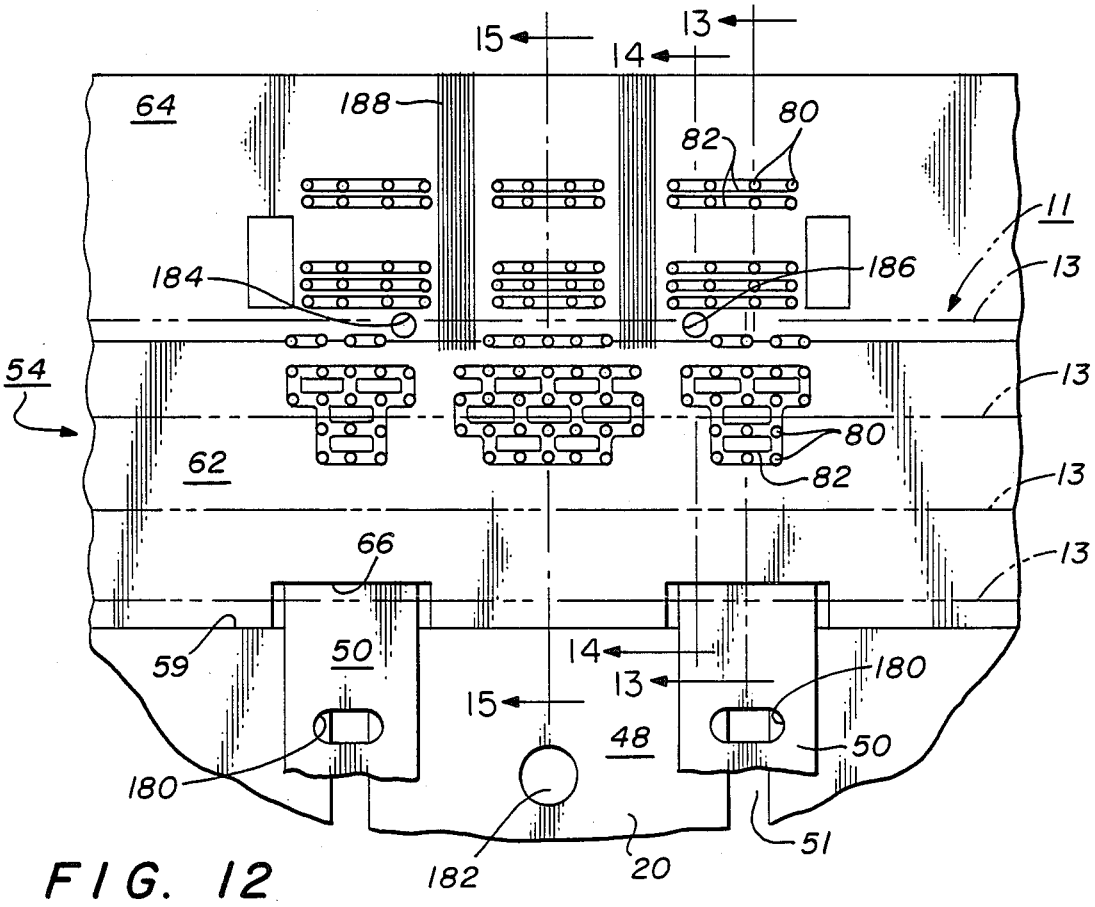
FIG. 12 is an enlarged fragmentary plan view of the vacuum ramp at which the shingled stack is supported for separation and transfer.
Figure 13:
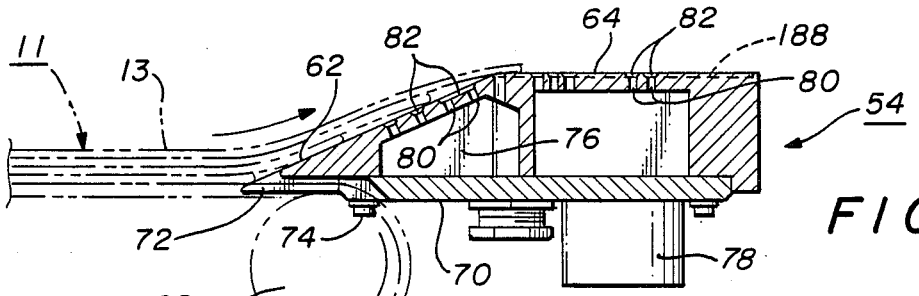
FIGS. 13, 14 and 15 are sectional elevations taken substantially from the positions 13—13, 14—14 and 15—15 respectively of FIG. 12.
Figure 14:
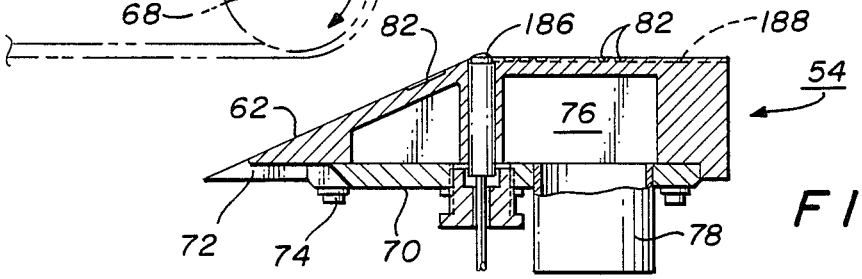
Figure 15:
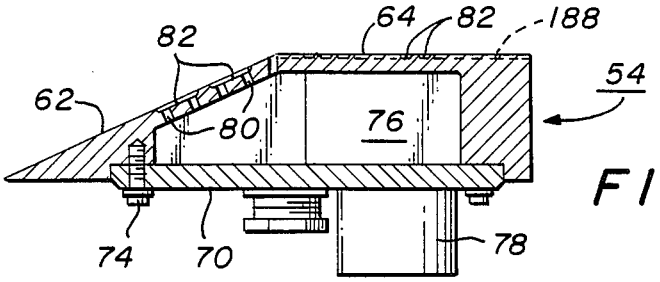

The individual needle grippers 105 are essentially U-shaped needles as shown in FIG. 11 with points 154 canted at about 45 degrees in the direction of feed from station 29. The needles are arranged within each array 109 and 111 in a staggered arrangement in picker cloth 107 (see FIG. 8) so as to collectively define the two gripper arrays each comprised of a predetermined uniform distribution of needle points 154 having distal ends which form the gripper surface for grasping a garment part 13. The elongated picker cloth 107 for the embodiment hereof is comprised of a thin rubber pad 113 on which is supported a felt belt 115 covered at its underside by a tape-like cover strip 117. Being constructed in that manner cloth 107 provides a limited degree of flexibility to the individual needles by affording cantilevered displacement whereby point breakage that could otherwise occur in the course of operation is minimized if not avoided. Cloth 107 is secured to the head 106 via a bracket 156 and a plurality of spaced apart screws 158. Also secured thereat extending longitudinally forward of the picker head is a wave like surface sensor strip 160 which determines the absence or presence of the support stack 11 for actuating the picker head operation.

Comprising an essential feature of the invention hereof is a rate of acceleration of picker head 104 on the order of 20–40 g's when separating the uppermost garment part 13 from the remainder of the stack 11. Toward that end, operation of cylinder 122 is characterized by its rod 120 incurring only a partial stroke within the length of its piston chamber while a differential pressure is controlled on opposite faces of the piston for effecting piston displacement in the manner of an air gun. Being that displacement of the piston rod 120 is rapidly accelerated, a highly accelerated arcuate moment is transmitted from the pivot axis 108 to the gripping surface of needle arrays 109 and 111. In this manner, the garment part 13 is removed from stack 11 with a "tablecloth" effect relative to the resistance to separation imposed by the surface coefficients of the superposed garment parts comprising stack 11 at station 29.

Figure 16:
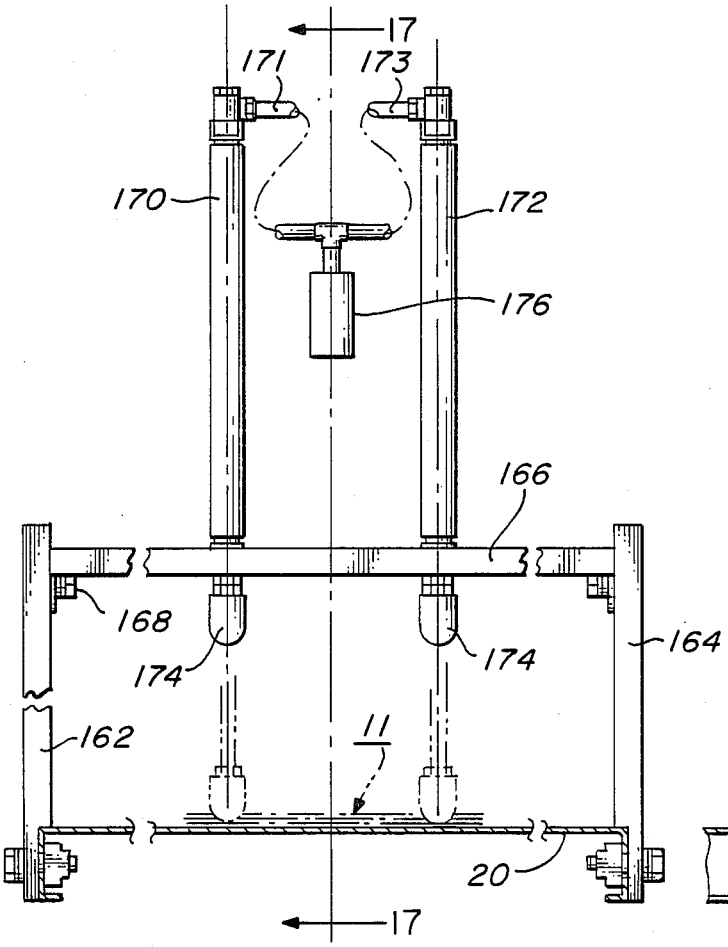
FIG. 16 is a front elevation of the hold down clamp.
Figure 17:
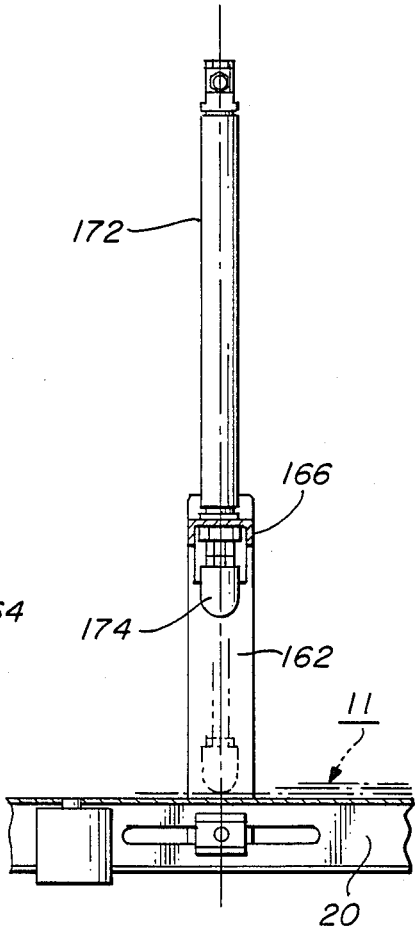
FIG. 17 is a side elevation of the hold down clamp of FIG. 16.

Operative concomitantly with picker head 104 for separating the uppermost garment part 13 is the operation of clamp hold down assembly 52 which will be described with specific reference to FIGS. 16 and 17. Comprising the clamp assembly 52 are a pair of upstanding spaced apart mounting blocks 162 and 164 secured at their lower ends on either side to the table 20. Joining the blocks together at their upper ends is a transversely extending channel section 166 bolted at its ends to the side blocks via bolts 168. Mounted upright through channel 166 at locations substantially symmetrical with respect to belts 50 are elongated pneumatic plunger cylinders 170 and 172. The plunger rods each depend downward from the underside of channel 166 and include a resilient friction textured finger cap 174 supported thereon for a surface forced engagement of the entire stack 11 at station 29. Cap 174 is adapted when the plunger rods are extended to their furthermost downward position to engage and impose a positive clamping force on the tail end of the first part 13 of stack 11 being separated. The vertical plane of rods 170 and 172 is such that the caps 174 will engage the uppermost part to be removed while permitting a high acceleration thereof in effecting its removal. After removal of the uppermost part, the caps will secure the next or second part to be removed.

Operation of the clamping mechanism 52 is controlled in timed relation with operation of picker assembly 86 and is activated by air pressure being applied to connectors 171 and 173. Control of the air pressure is effected through solenoid 176 whereby the plungers of cylinders 170 and 172 are stroked downwardly from the position shown solid to the position shown in phantom in FIGS. 16 and 17. Operation of the clamping device 52 is in combination and concomitantly with vacuum being supplied in plenum 78 and to the apertures 180 in belts 50 through slots 51. A sensor 182 positioned between the belts 50 serves to activate belt vacuum in timed relation to operation of the picker head 86.

Figure 18:
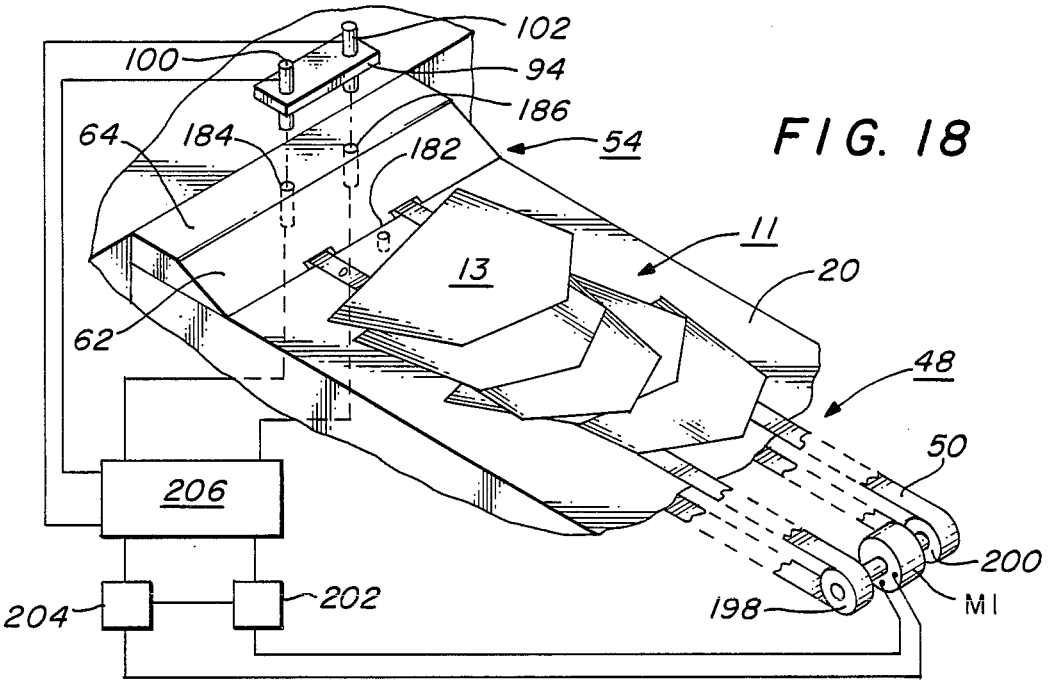
FIG. 18 is a somewhat schematic diagram of the arrangement for feeding and aligning the stacked parts prior to separation.

Illustrated in FIG. 18 is the conveyor 48 for conveying a shingled stack 11 toward the front support surface 62 of ramp block 54. The conveyor includes conveyor belts 50 trained around spaced apart pulleys 198 and 200. The pulleys are each drive connected to an electric motor M-1 suitably connected to a power source through switch 202 and master switch 204. The switch 202 is adapted to be controlled by a control circuit 206 which includes photoelectric sensor elements 184 and 186 positioned aligned with each other along a line generally perpendicular to the direction of movement of the belts 50.

The sensors 184 and 186 are operable to detect the presence of a leading edge of a garment part 13 on top of the stack 11 and, accordingly, positioned to be next separated from the stack. The orientation of the leading edge of each of the parts 13 may be such that, upon engagement of the part to be separated from the stack by the separating mechanism 10 described herein, the leading edge of the part may remain skewed with respect to the direction of past travel. This could result in the part being improperly gripped or engaged by the picker assembly 104 which would tend to foul the operation of the separating and feeding apparatus. In accordance herewith it is contemplated that the sensors 184 and 186 may operate the switch 202 through the control circuit 206 to effect operation of the motor M-1 whereby the stack 11 may be oriented to position the leading edge of part 13 generally perpendicular to the line of travel of the stack 11. When the stack arrives against ramp face 62 at station 29 it is arrested against further movement. In response to a signal from the sensors 182–184 indicating that the part to be separated has reached ramp surface 64 in proper alignment, the picker assembly is readied for operation.

The control system illustrated in FIG. 18 is preferably arranged to be operable as follows. When neither sensor 182, 184 is interrupted from receipt of light from emitters 100–102, it reflects the absence of a part 13 in position for engagement by the separating mechanism, and the switch 204 may be actuated to energize motor M-1 to advance the stack 11 further toward the surface 64. If either of the sensors 184 or 186 senses the presence of the edge of the leading part 13 of stack 11, the motor will be allowed to continue operating to drive the conveyor belts 50 until the other sensor likewise detects the presence of the leading edge. In this way the stack will be oriented such that the leading edge of a part 11 will be turned to align the edge generally perpendicular to the intended direction of travel of the stack as provided by the conveyor 48. Once both sensors have indicated the presence of the edge the switch 202 may be closed thereby advancing the stack until operation of the picker assembly is initiated.

Figure 21:
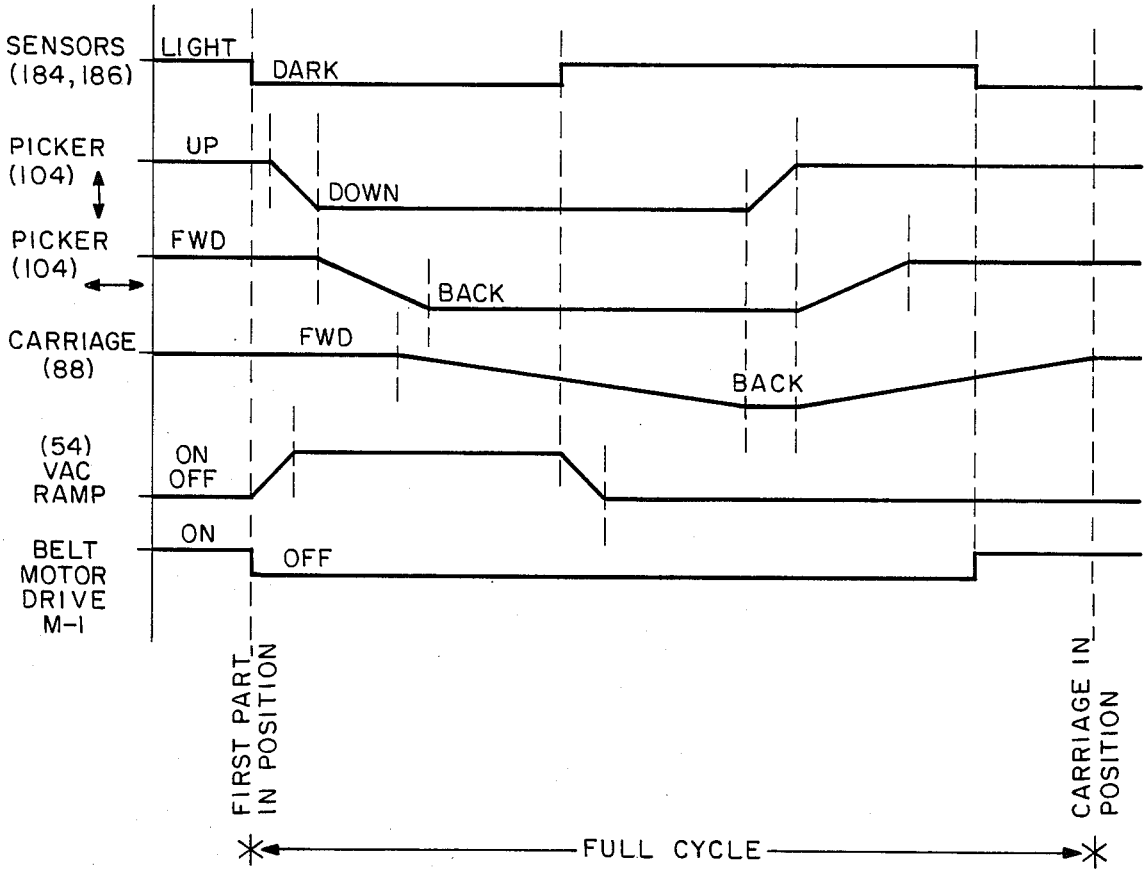
FIG. 21 is a motion diagram for sequentially activating and deactivating the control components that operate the various mechanisms hereof.

The various controls for effecting operation in the appropriate timing sequence are scheduled to operate in the relative motion relation shown in FIG. 21. In operation, photo sensors 184 and 186 located in block 54 cooperate with emitters 100 and 102 on the assembly head to prevent operation of the picker head unless the part 13 is properly aligned as will cause both light paths therebetween to be interrupted. At such time as the top part 13 is to be separated from the stack 11, the picker head 106 while being forced downwardly by extending the rod of cylinder 142, is concomitantly first tilted clockwise (FIG. 5) to the extent possible by extending the rod cylinder 122. When the needle arrays 109,111 effect a penetrating engagement with the top part 13 thereat, piston cylinder 122 is reversed in a rapid accelerating displacement causing the picker head 106 to incur a considerable leveraged acceleration in a counterclockwise direction. The effect of the latter is to separate part 13 while carriage 88 is moved on rod 92 from the position shown in solid to the position shown in phantom in FIG. 5. In the course of carriage movement, the part 13 is drawn along the surface of table 56 which includes a plurality of longitudinal grooves 188 in which to receive the penetrating needle points 154 in the course of travel. The grooves thereby permit the needle points to penetrate the garment material without point damage being incurred. On arriving at the rearward destination, the garment part 13 comes to rest on guide 57 (FIG. 1) from which it is fed independently to a sewing machine or the like 58.

Representing an important aspect of the apparatus hereof as noted supra is the feature of high acceleration imposed on garment part 13 in the course of being separated from the stack with a snap action tablecloth-like effect. The intention thereof is to impose a rate of acceleration on the order of 20–40 g's against the uppermost part 13 so as to impart an acceleration force that the material composition of garment part 13 can reasonably withstand. Obviously, the actual rate of acceleration will vary somewhat dependent on the magnitude of acceleration force that the different material part compositions can readily tolerate without being damaged. During the acceleration the remainder of the stack is being retarded by a combination of the clamping force imposed by clamping mechanism 52 and the vacuum force being applied to the underside of the stack through apertures 80 and 180 and grooves 82. For those purposes, the retarding force imposed must be greater than the friction force between the first and second garment parts in resisting the acceleration force being imposed by virtue of the relative friction coefficients therebetween. In mathematical terms, the foregoing relationships can be expressed as follows:

Legend:
$\mu$=Moving Friction
$\mu^\circ$=Breakway Friction
$\mu^\circ \geqq \mu$
M=Mass of Part or Subassemblies
W=Weight of Part or Subassemblies
F=Accelerating Force
P=Plunger or Wheel
A=Acceleration
G=Gravity
f=Function of
Suffix:
1=First Part
2=Second Part
3=Third Part
r=Retarding
a=Accelerating

OBJECTIVE

Accelerating Force<Retarding Force (On Second Part)

$F_a < F_4\ (M \times G) = W; \mu^\circ_{12}$ may be $>; <; = \mu^\circ_{23}$
$(M_1 \times G) \times \mu^\circ_{12} < [(M_1 + M_2) \times \mu^\circ_{23}]A$

OBJECTIVE $\mu = F(P; W)$ $[(F_p + W_1) \times \mu^\circ_{12}] < [(F_p + W_1 + W_2) \times \mu^\circ_{23}]$ Successful separation based on this principle (without consideration of the vacuum or other restraining forces being imposed) is enhanced if the trailing edge of the first part is withdrawn from beneath the plungers 170 and 172 before the acceleration subsides. Once initial breakaway has been achieved, the friction between the first and second parts 13 reduces from $\mu^\circ$ to $\mu$ whereas the friction between the second and third parts remain $\mu$.

It will be appreciated that some garment materials such as corduroy and brushed denim have different surface textures and different friction coefficients on one face versus the other. As a consequence, such parts when stacked are more difficult to separate individually by sliding one over the other. For dealing with this situation it has become common for the cutting room to disperse such parts in shingled pairs whereby drawing or pulling the uppermost shingle from a stack will result in the uppermost pair of parts, rather than the individual part, being removed. In that situation, subsequent separation of the pair parts and inversion of one part is required.

Figure 19:
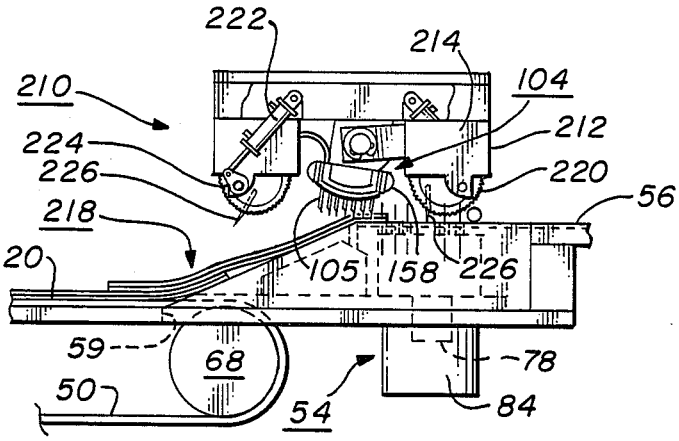
FIG. 19 is a partial elevation view for an optional picker head for supporting the picker array in accordance with an alternate embodiment.
Figure 20A:
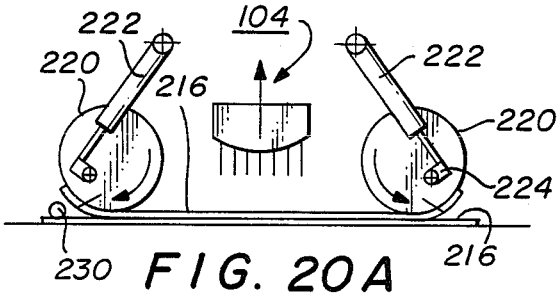
FIGS. 20A–B inclusive are diagrammatic illustrations of an optional separating bar mechanism in accordance with the alternate embodiment of FIG. 19.

Referring now to FIGS. 19 and 20, a modification of the separating and feed apparatus 10 with regard to the mechanism for removing shingled parts in pairs rather than individually will be described. FIG. 19 illustrates a modification of the apparatus 10, generally designated by the numeral 210 and comprising essentially all of the components of the apparatus 10 contained in a head apparatus generally designated by the numeral 212. Contained in head apparatus 212 is support member 214 comprising part of the mechanism for engaging and separating a pair of fabric parts 216 and 217 from a stack of paired fabric parts 218. As noted, the paired parts 216 and 217 are presented on the surface 62 of ramp 54 as before for being arranged paired in a shingled or staggered configuration in the manner similar as the parts 13 are arranged in the stack 11.

The mechanism of apparatus 210 for separating the paired parts from each other after paired removal from the stack may be an adaptation of that described in U.S. Pat. No. 4,143,871. The support member 214 is adapted to support a pair of opposed cylindrical part engaging curling wheels 220 which are rotatably mounted thereon via suitable opposed spaced apart brackets 221. Picker head 104, secured and operative as above, is positioned intervening the curling wheels 220. Each of the wheel members 220 are operably connected to an actuator 222 having a crank arm 224, (one shown) connected to the members 220. The crank arms are operative post-removal of the pair from the stack for rotating the members 220 in opposite directions to positively engage part 216 at opposite ends by opposed engaging needles 226. Via the needles the ends of part 216 are curled to initiate separation of parts 216 and 217 from each other. The needles 226 are suitably supported on the members 220 and extend generally radially outward through a foam rubber outer shell portion 228 as more completely disclosed in the parent application hereof. The cylinder members 220 are mounted on the brackets 221 transverse to the direction of part separation and feed and, in response to energization of the actuators 226 positively engage the front and rear end portions of a fabric part 216 for curling the ends thereof upward relative to bottom part 217 in the manner illustrated in FIG. 20A. Once end curling has been completed separation between the paired parts 216 and 217 is completed by means of a separation roll 230. The separation roll, which may be an adaptation of that described in U.S. Pat. No. 4,143,871, is advanced longitudinally from rear to front and return intervening between the looped underside of part 216 and the top surface of part 217.

Figure 20B:
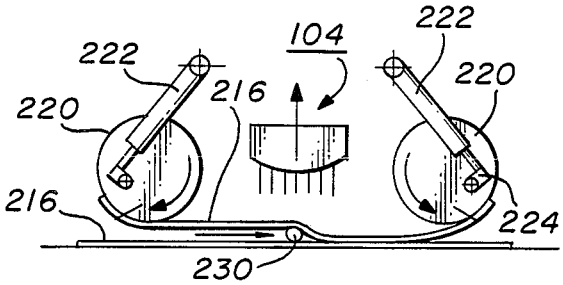

In operation of the embodiment of FIGS. 19 and 20, the apparatus 210 includes picker head 104 that is operative as before for removing shingled pairs of parts 216 and 217 from stack 218 on ramp 54. Pair removal from the stack is at an acceleration rate of 20–40 g's from beneath clamp assembly 52 while vacuum is being applied against the underside of the stack for retarding removal of the stack remainder. Unlike the previous embodiment in which following removal the removed part is fed to the rear of table 20, the unit 212 is operative to be halted in the feed stroke following pair removal at an intermediate location along table 20. On reaching the halt location, end curling by activating curling wheels 220 is initiated whereby the needles 226 curl the front and rear ends of part 216 upward relative to part 217 on table 20. By raising unit 212 slightly, roller 230 is advanced longitudinally to complete the separation between parts in the manner illustrated in FIG. 20B. Once the parts are separated, rearward movement of unit 212 is restored for transferring the removed part 216 to the rear of table 20.

Figure 5:
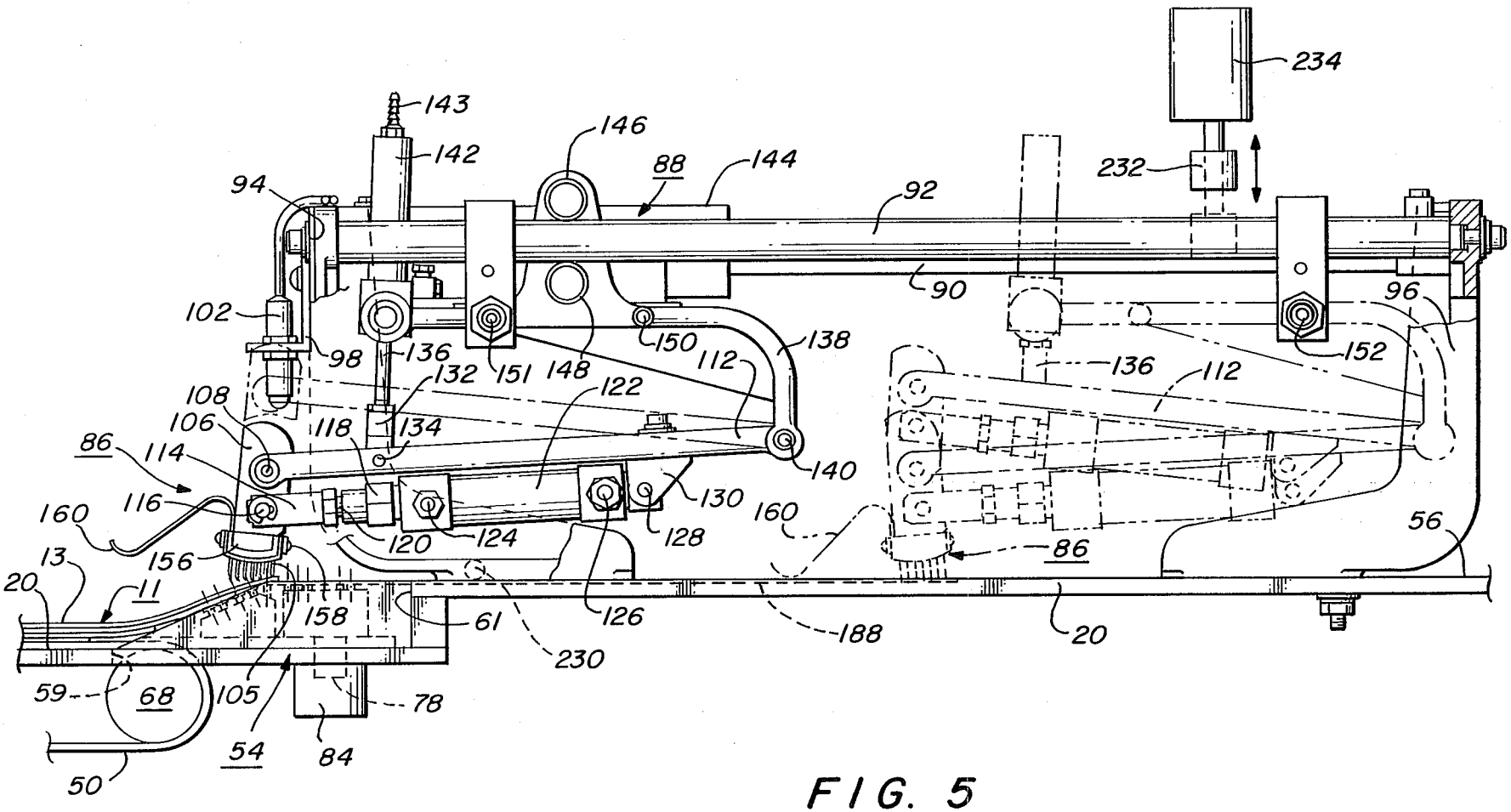
FIG. 5 is side elevation of FIG. 4.
Figure 6:
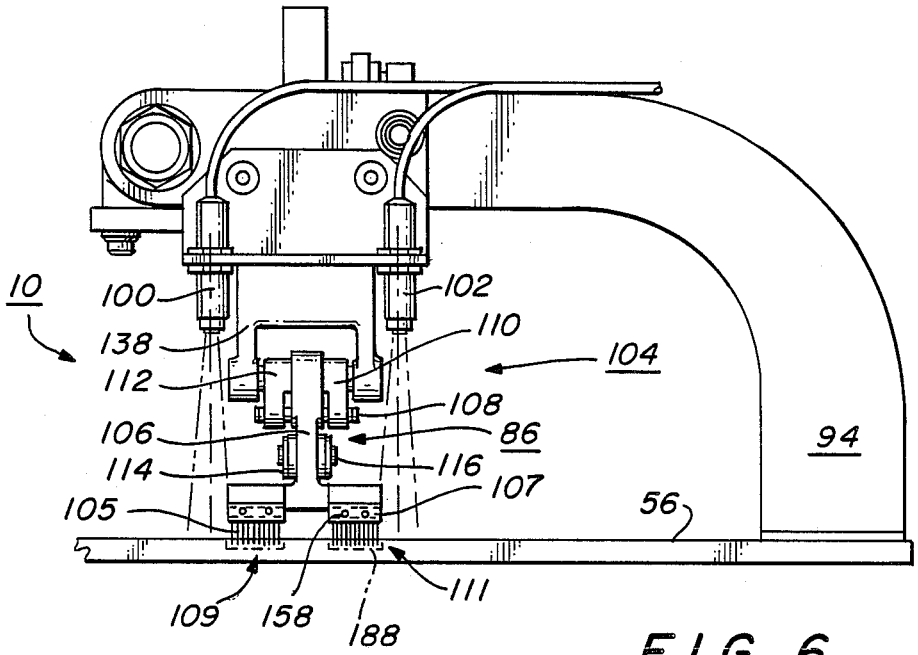
FIG. 6 is an end elevation of FIG. 4.
Figure 7:
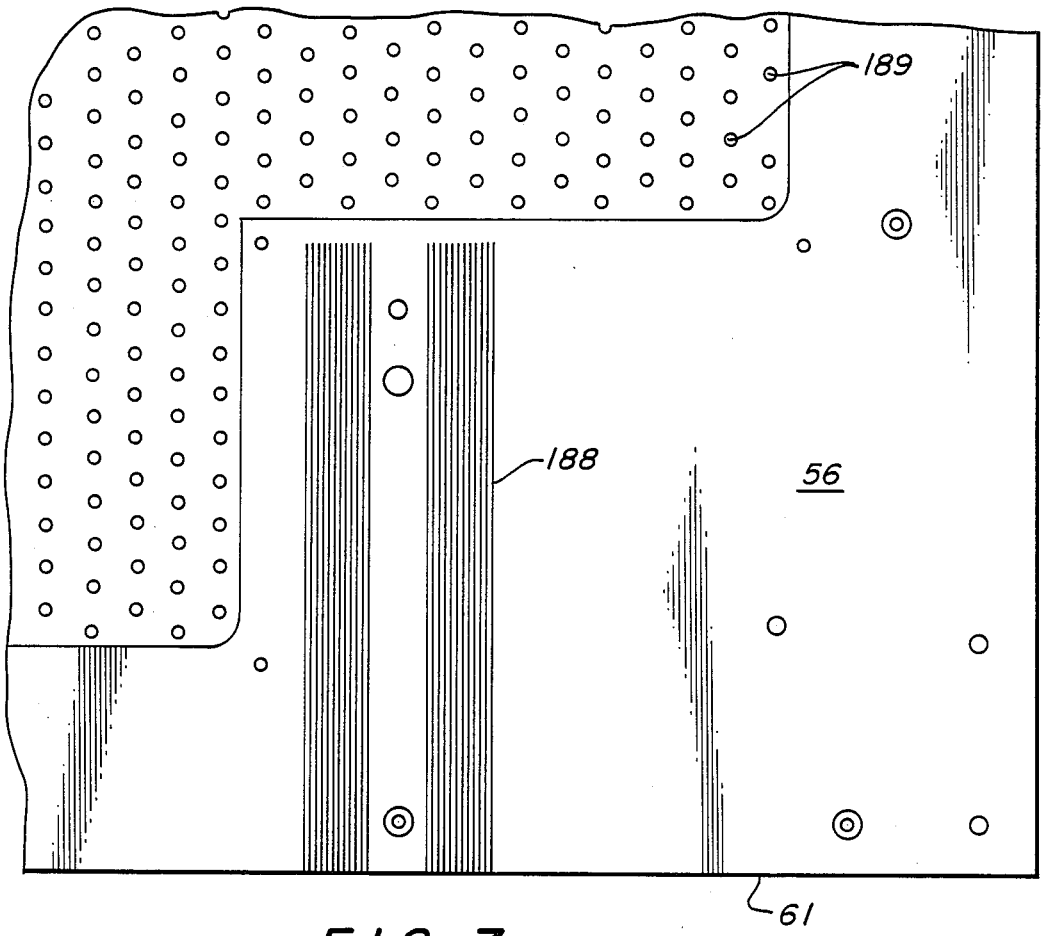
FIG. 7 is a fragmentary enlargement of the transfer surface of FIG. 4.
Figure 8:
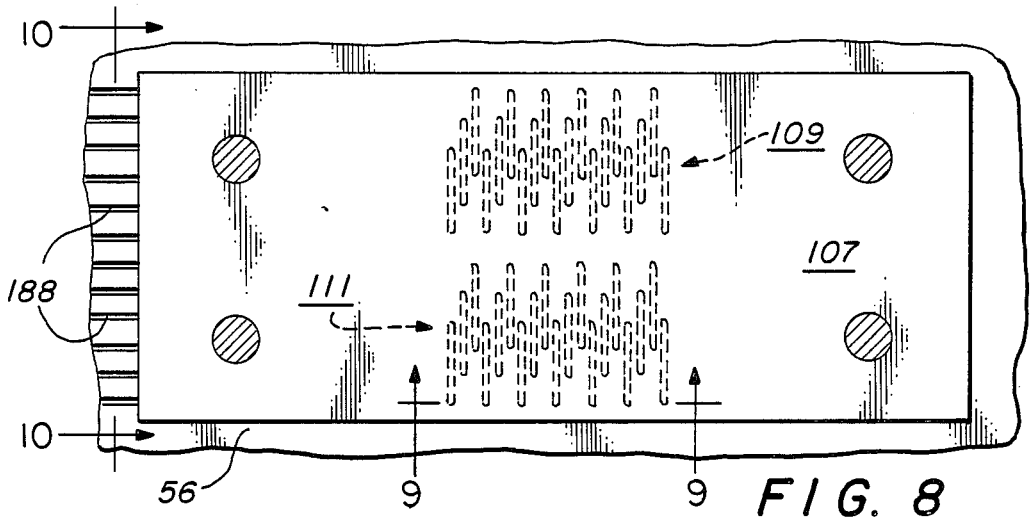
FIG. 8 is an enlarged view of the picker array.
Figure 9:
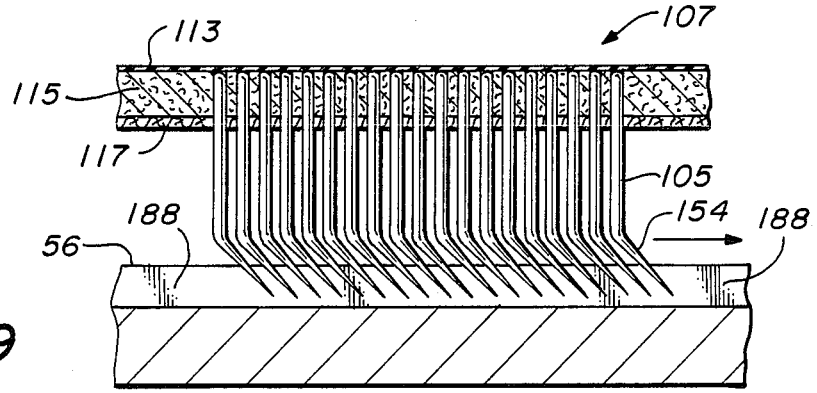
FIG. 9 is a side elevation view of the picker array as seen from the position 9—9 of FIG. 8.
Figure 10:
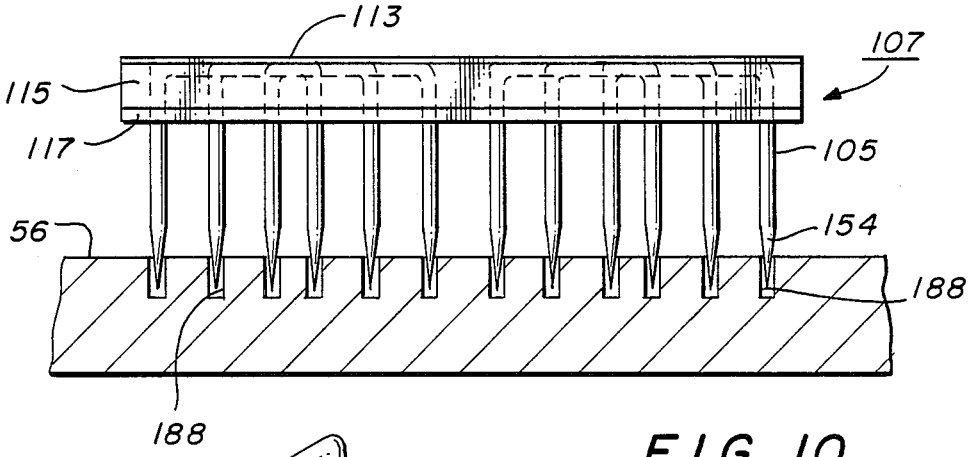
FIG. 10 is an elevation view of the needle of the picker array as seen from the position 10—10 of FIG. 8.

Since when transferring part 216 part 217 is left at the intermediate stop location, the unit 212 is returned in the return stroke of the carriage to the stop location for retrieving part 217. Interruption of the carriage return stroke on alternate return cycles for that purpose is under control of a drop-in-stop 232 actuated by a pneumatic cylinder 234 (FIG. 5). By this arrangement unit 212 is returned for a pair removal from stack 218 on ramp 54 only on alternate cycles while being returned in the intervening cycles to the stop location for retrieving part 217. Part inversion, when required, is provided subsequently.

By the above description there is disclosed novel apparatus for separating and feeding shingled garment parts seriatim from a stack of said shingled parts to a work station. The apparatus includes a novel part picker which not only effects a positive grasp of the leading edge of the uppermost shingle but concomitantly imposes a highly accelerated motion thereon to effect separation of the part from the remainder of the stack. Preferably, the rate of relative acceleration between the first and second garment parts will achieve separation therebetween largely based on the tablecloth principle described supra. Concomitantly with the grasping of the uppermost shingle, any tendency of the remaining shingles to move forward is positively retarded by a combination of a clamping force imposed from the top side against the stack while a vacuum is being applied from the stacked underside against the undersurface of the lowermost of the garment parts. Applying the perpendicular clamping force in this manner to the trailing edge of the uppermost part in combination with a greater friction force existing between the first and second parts as well as between the second and third parts produces a greater motion restricting force on the second part as compared to the force being imposed thereon by the accelerating force of the first part. This therefore serves to inhibit the trailing edge of the second part from being rolled over and following the first part as the latter is being separated.

Being that the picker head 104 provides a rocking and rapid arcuate motion in combination with two separate arrays of needle points affording a positive grasp of the garment material, separation and feeding of the individual shingled parts is assured at the accelerated rate at which the picker is operative. At the end of the feed stroke, the picker head is elevated and withdrawn from the garment part whereby the part is released for being independently advanced to the next work station on which a particular stitching or sewing operation is to be performed.

Where the contiguous parts are characterized by dissimilar surface friction top and bottom, a picker head of an alternative embodiment is utilized for withdrawing the parts from the stack in pairs. The removed pairs are subsequently separated from each other by a pair of curling wheels and a separation bar that is passed intervening between the parts while the lower part is being retarded. Following part separation, the parts are transferred separately in sequential cycles of the picker head to the end of the feed stroke as before.

Since many changes could be made in the above construction and many apparently many widely different embodiments of this invention could be made without departing from the scope thereof, it is intended that all matter contained in the drawings and specification shall be interpreted as illustrative and not in a limiting sense.

We claim:

1. Apparatus for the seriatim removal of parts of garment material from a shingled stack of the parts and feeding the removed parts to a predetermined destination, said shingled stack having a top part and remaining parts beneath the top part, each part in the stack having a top portion, a bottom portion, a leading edge portion and a trailing edge portion, said apparatus comprising:

support surface means forming a support surface for supporting at least a portion of the stack including the parts to be removed from the stack at a predetermined position on said support surface;

hold down means for exerting a clamping force against the trailing edge portion of the top part operable for holding remaining parts while the top part is being removed; and, engagement means for effecting a gripping engagement with the top part and imparting a rapid acceleration thereto to remove the engaged top part from beneath the hold down means and away from the remaining parts in the stack.

2. Apparatus in accordance with claim 1 in which the acceleration imparted by said engagement means is in the range of from about 20 g's to about 40 g's.

3. Apparatus in accordance with claim 1 in which the parts of the stack are shingled in pairs with each part being characterized by a surface friction on the top portion of the part different than the surface friction on the bottom portion of the part, said top part comprising an uppermost pair in the stack and said remaining parts comprising any remaining pairs in the stack, and said engagement means is operative for engaging and removing the paired parts from the stack in their paired relation.

4. Apparatus in accordance with claim 3 including separation means operative following removal of the paired parts to effect separation of the paired parts from each other.

5. Apparatus in accordance with claims 1 or 3 wherein said engagement means comprises; a support means; at least one picker array attached to said support means and having a plurality of substantially coplanar needle points terminating downwardly and operable to move arcuatedly at said rapid rate of acceleration during removal of the top part from the remaining parts; an actuating means attached to said support means for effecting arcuate movement of the picker array; and a drive means for moving said support means between said predetermined position and said predetermined destination.

6. Apparatus in accordance with claim 5 including retarding means operable concomitantly with said hold down means for holding the bottom portion of at least some of the remaining parts in the stack to aid in retarding said stack as the engaged top part is removed therefrom.

7. Apparatus in accordance with claim 6 in which said retarding means comprises means for applying a vacuum force to the bottom portion of at least some of the remaining parts in the stack.

8. Apparatus in accordance with claim 6 including conveyor means for advancing the stack parts from a source of the parts to said support surface in a shingled and stacked relation.

9. Apparatus in accordance with claim 8 in which said conveyor means includes a ramp extending from a source of the stack parts to the support surface, said ramp including a plurality of apertures defined through the surface thereof, and means effective to apply a vacuum pressure through said apertures to the bottom portion of remaining parts in the stack in timed relation to the operation of said picker array.

10. Apparatus in accordance with claim 6 in which hold down means includes a plurality of spaced apart plunger means supported extending substantially upright substantially perpendicular to the trailing edge portion of the top part in the vicinity of the support surface and operable between a first position disengaged from the top part and a second position engaging the trailing edge portion of the top part while applying a hold down force against the remaining parts in the stack for resisting the following force of the top part on being removed from the remaining parts in the stack, and means for actuating said plunger means between said first and second positions.

11. Apparatus in accordance with claim 10 in which said hold down means applies a magnitude of force against the trailing edge portion of the top part of the stack which effects a lesser surface friction between the hold down means and the top part than exists between the surfaces of the garment parts in the stack.

12. Apparatus in accordance with claim 11 in which the magnitude of force applied by said hold down means is sufficient to inhibit the trailing edge portion of the remaining parts from incurring rollover and following the top part as the top part is removed.

13. Apparatus according to claim 5 in which said drive means is operative at said predetermined position to place said picker array at said predetermined destination and is operative at said predetermined destination to place said picker array at said predetermined position.

14. Apparatus in accordance with claim 5 including a second support surface between the predetermined position and the predetermined destination and over a top surface of which the engaged top part is advance after removal from the stack, said picker array remaining engaged with the top part in the course of being advanced over said second support surface, and said top surface of said second support surface including a plurality of longitudinal grooves at a location coincident with the travel path of the individual needle ends of the array for receiving the needle ends of said array penetrating the engaged garment part as the engaged part is moved from the predetermined position to the predetermined destination.

15. Apparatus in accordance with claim 5 in which the force of the imparted acceleration is selected in correlation to the strength of the material comprising the garment parts.

16. Apparatus according to claim 8 in which said conveyor means comprises at least two conveyors serially arranged and including a drive means for said conveyors operable for effecting a preselected differential rate of transport between the conveyors.

17. Apparatus according to claim 5 in which the drive means in pneumatically or hydraulically powered.

18. Apparatus according to claim 16 in which said differential rate of transport between the conveyors is used to control the distance between the leading edges of the parts in the shingled stack.

19. Apparatus for the seriatim removal of parts of garment material from a shingled stack of the parts to a predetermined destination, said shingled stack having a top part and remaining parts beneath the top part, each part in the stack having a leading edge, a trailing edge, a top surface and a bottom surface and arranged in a shingled fashion in the stack such that the leading edge of each part in the stack extends beyond the leading edge of any underlying part in the stack, said apparatus comprising:

a support surface for supporting at least the top part and some of the remaining parts in the stack as the stack is advanced toward a predetermined position for separation;

an engagement means suspended above the support surface and operable for removably attaching itself to the leading edge of the top part, imparting a rapid acceleration to the top part and the remaining parts in the stack, moving the top part from the stack to the predetermined destination, disengaging itself from the leading edge of the top part, and returing to the predetermined location for removing the next top part in the stack; and, a hold down means for exerting a clamping force against the trailing edge of the top part during separation of the top part from the remaining parts in the stack.

20. The apparatus of claim 19 in which said engagement means includes at least one picker array having a plurality of downwardly extending needle points for engaging the leading edge of the top part and an actuating means for moving the picker array into engagement with the top part and for removing the top part from the remaining parts in the stack to the predetermined destination.

21. The apparatus of claim 20 in which the support surface includes a top surface which extends to said predetermined destination and includes longitudinal grooves in said top surface extending from said predetermined location to said predetermined destination for receiving the needle ends of the array penetrating the top part as the top part is moved from the predetermined location to the predetermined destination.

22. The apparatus of claim 19 in which the hold down means includes a plurality of plunger means supported substantially upright and perpendicular to the top surface of the top part at the trailing edge thereof and operable between a first position disengaged from the top part to permit the stack to advance unimpeded to the predetermined position and a second position applying a clamping force against the trailing edge of the top part and the remaining parts in the stack of a sufficient magnitude to permit removal of the top part from under the plungers by the sudden acceleration of the top part during removal while preventing the remaining parts in the stack from following.

23. The apparatus of claim 19 additionally comprising a retarding means operable concomitantly with the hold down means for holding the bottom surface of the remaining parts in the stack to assist in preventing any remaining parts in the stack from following as the top part is removed.

24. The apparatus of claim 23 in which the retarding means includes a means for applying a vacuum to the bottom of at least some of the remaining parts in the stack.

25. The apparatus of claim 19 additionally comprising a conveyor means for advancing the stack towards the predetermined location.

26. The apparatus of claim 25 in which said conveyor means comprises at least two conveyors arranged serially to provide a differential rate of transport between the conveyors.

27. The apparatus of claim 26 in which the differential rate of transport between the conveyors is used to control the distance between the leading edges of the parts in the shingled stack.

* * * * *

UNITED STATES PATENT AND TRADEMARK OFFICE

CERTIFICATE OF CORRECTION

PATENT NO. : 4,871,161

DATED : October 3, 1989

INVENTOR(S) : HUBERT BLESSING et al

It is certified that error appears in the above - identified patent and that said Letters Patent is hereby corrected as shown below:

In the Specification:

Col. 9, line 35, F4 should be "Fr"

In the Claims:

Claim 5, Col. 12, line 46 should read:
"move [arcuatedly] arcuately at said rapid rate of acceleration dur-"

Claim 14, Col. 13, line 38 should read:
"top surface of which the engaged top part is [advance] advanced"

Claim 19, Col. 14, line 11 should read:
"rapid acceleration to the top part to impart a table cloth effect between the top part and the remaining"

UNITED STATES PATENT AND TRADEMARK OFFICE

CERTIFICATE OF CORRECTION

PATENT NO. : 4,871,161

DATED : October 3, 1989

INVENTOR(S) : Hubert Blessing, et al.

It is certified that error appears in the above-identified patent and that said Letters Patent is hereby corrected as shown below:

Claim 19, Col. 14, line 14 should read:
"[returing] returning to the predetermined location for remov-"

Claim 19, Col. 14, line 6 should read:
"stack is advanced toward a predetermined [position] location"

Signed and Sealed this

Twentieth Day of November, 1990

*Attest:*

HARRY F. MANBECK, JR.

*Attesting Officer*

*Commissioner of Patents and Trademarks*